US007427064B2

(12) United States Patent
Förch et al.

(10) Patent No.: US 7,427,064 B2
(45) Date of Patent: Sep. 23, 2008

(54) MACHINE FOR PROCESSING A SHEET OF PRINTING MATERIAL

(75) Inventors: Peter Förch, Neustadt (DE); Markus Möhringer, Weinheim (DE); Stefan Mutschall, Östringen (DE); Paul Nicola, Heidelberg (DE); Marius Stelter, Heidelberg (DE); Ralf Wadlinger, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 445 days.

(21) Appl. No.: 11/190,290

(22) Filed: Jul. 27, 2005

(65) Prior Publication Data

US 2006/0022398 A1 Feb. 2, 2006

(30) Foreign Application Priority Data

Jul. 27, 2004 (DE) ..... 10 2004 036 421

(51) Int. Cl.
*B65H 29/04* (2006.01)

(52) U.S. Cl. ..... 271/204; 271/277; 271/206; 101/232

(58) Field of Classification Search ..... 271/204, 271/198, 188; 101/232; 198/817, 626.5, 198/462.3, 461.3, 604, 606, 626.1
See application file for complete search history.

(56) References Cited

U.S. PATENT DOCUMENTS 3,167,012 A * 1/1965 Claybourn ..... 101/416.1
3,413,732 A * 12/1968 Werner et al. ..... 34/660
3,861,672 A 1/1975 Norton
4,013,284 A * 3/1977 Demetre ..... 271/183
4,083,556 A * 4/1978 Schilling et al. ..... 271/204
4,409,741 A * 10/1983 Bonomi ..... 34/660
4,479,645 A * 10/1984 Pollich ..... 271/183
4,977,828 A 12/1990 Douglas
5,431,386 A * 7/1995 Blaser ..... 271/204
6,098,976 A * 8/2000 Gieser et al. ..... 271/183
6,401,611 B1 * 6/2002 Gunschera ..... 101/232
6,578,846 B2 * 6/2003 Maul et al. ..... 271/277
6,663,550 B2 * 12/2003 Frankenberger et al. ..... 493/256
6,702,283 B2 * 3/2004 Berlingen et al. ..... 271/276

(Continued)

FOREIGN PATENT DOCUMENTS

DE 1 217 402 5/1966

(Continued)

*Primary Examiner*—Patrick Mackey
*Assistant Examiner*—Luis A Gonzalez
(74) *Attorney, Agent, or Firm*—Laurence A. Greenberg; Werner H. Stemer; Ralph E. Locher

(57) ABSTRACT

A machine for processing a sheet of printing material contains a first chain conveyor having a first gripper bar for holding a leading edge of the sheet, and a second chain conveyor having a rear gripper bar for simultaneously holding a trailing end of the sheet. A processing device is assigned to the chain conveyors for processing the sheet. A distance changing device is provided for temporarily reducing a gripper distance between the two gripper bars and, consequently, producing a sheet sag required for the processing of the sheet carried out by the processing device. The distance changing device defines a first circulation path of the front gripper bar, determined by the first chain conveyor, and a second circulation path of the rear gripper bar, determined by the second chain conveyor, running locally differently from each other. The processing device can be, for example, a sheet smoother.

14 Claims, 4 Drawing Sheets

U.S. PATENT DOCUMENTS

| | | | | |
|---|---|---|---|---|
| 6,729,615 | B2 * | 5/2004 | Luongo et al. | 271/188 |
| 7,198,267 | B2 * | 4/2007 | Forch et al. | 271/204 |
| 7,261,291 | B2 * | 8/2007 | Forch et al. | 271/183 |
| 7,267,053 | B2 * | 9/2007 | Beitel et al. | 101/232 |
| 2002/0135123 | A1 | 9/2002 | Maul et al. | |
| 2002/0164183 | A1 * | 11/2002 | Berlingen et al. | 399/406 |

FOREIGN PATENT DOCUMENTS

| | | | |
|---|---|---|---|
| DE | 105 788 | | 5/1974 |
| DE | 24 58 446 | A1 | 7/1975 |
| DE | 34 09 314 | A1 | 1/1985 |
| DE | 38 31 753 | A1 | 5/1989 |
| DE | 39 28 992 | A1 | 3/1990 |
| DE | 42 18 421 | A1 | 12/1993 |
| DE | 42 41 789 | A1 | 6/1994 |
| DE | 197 22 376 | A1 | 12/1997 |
| DE | 197 33 692 | A1 | 2/1999 |
| DE | 100 14 417 | A1 | 9/2001 |
| DE | 103 49 668 | A1 | 5/2004 |
| GB | 2 273 288 | A | 6/1994 |

* cited by examiner

MACHINE FOR PROCESSING A SHEET OF PRINTING MATERIAL

BACKGROUND OF THE INVENTION

Field of the Invention

The present invention relates to a machine for processing a sheet of printing material. The machine contains a first chain conveyor having a first gripper bar for holding a leading edge of the sheet, and a second chain conveyor having a rear gripper bar for simultaneously holding a trailing end of the sheet. The machine further has a processing device assigned to the chain conveyors for processing the sheet and a distance changing device for temporarily reducing a gripper distance between the two gripper bars and, consequently, producing a sheet sag required for the processing of the sheet carried out by the processing device.

The invention arose against the now described background. The processing device can be a sheet smoother, past which the two chain conveyors transport the sheet, in order that the sheet is de-curled by the sheet smoother in the process. If the gripper bars were to hold the sheet tautly, that is to say without any sheet sag, in the active region of the sheet smoother, then no printing material bead on the sheet could be formed which could be drawn by the sheet smoother into the smoothing gap of the latter. Therefore, for the sheet smoothing or de-curling, it is necessary to shorten the gripper bar distance shortly before the sheet enters the active region of the sheet smoother and, as a result, to bring about the sheet sag. Since it is advantageous to convey the sheet without the sheet sag outside the active region of the sheet smoother, after sheet smoothing has been carried out, the gripper bar distance must be enlarged to its original dimension again, which depends on the format length of the respectively processed sheets, by the aforesaid distance changing device.

A machine corresponding to the generic type mentioned at the beginning is described in published, non-prosecuted German patent application DE 100 14 417 A1, corresponding to U.S. Pat. No. 6,578,846. In this machine, the processing device is a sheet smoother and a format adjustment, carried out on the basis of the respective sheet length to be processed, is mentioned, in which an adjustment of the phase angle of the second chain conveyor relative to the first chain conveyor is carried out. Although, during the phase angle adjustment, the gripper bar distance existing between the front gripper bar and the rear gripper bar is changed, this change in the distance is of a permanent nature, since the gripper bar distance set in the process is maintained unchanged during the processing of the entire print job. Furthermore, the aforementioned laid-open specification mentions the fact that it is not absolutely necessary for the front gripper bar and the rear gripper bar to run on circulation paths lying in one and the same area. In the aforementioned German patent application, however, there are no positive statements relating to the formation of the distance change device producing the sheet sag required for the sheet smoothing.

In connection with the present invention or in its preliminary stage, various possible ways of forming the aforesaid distance change device has been assessed by the applicant but have been rejected again for the reasons explained below.

One possibility would be to adjust the phase of the second chain conveyor relative to the first chain conveyor at the sheet cycle rate. Because of these periodic phase adjustments, however, not only would the gripper bar distance between the aforementioned two gripper bars change, which form a pair of gripper bars, but at the same time also the gripper distances between gripper bars of further such pairs of gripper bars of the chain conveyor would change. This undesired but unavoidable change in the gripper bar distances of the further pairs of gripper bars, which hold sheets already smoothed by the sheet smoother, would disrupt the deposition of the already smoothed sheets on the delivery stack.

Another possibility would be to fit the rear gripper bar on the second chain conveyor or the endless chains of the latter such that they can be moved in such a way that the rear gripper bar can be moved relative to the endless chains and to the front gripper bar. In order to provide this actuating movement, the endless chains would have to carry actuating drives, whose power supply is complicated, since the actuating drives would circulate together with the endless chains. Since, in most applications, the second chain conveyor not only has a single rear gripper bar but a plurality of gripper bars which form the aforesaid pairs of gripper bars together with the front gripper bars of the first chain conveyor, a correspondingly high number of actuating drives would have to be present, which would result in high manufacturing costs.

According to another possible alternative, the movement carried out relative to the endless chains and to the front gripper bar could be effected by an actuating drive which is not fixed to the endless chains but to the machine frame and which adjusts the rear gripper bar relative to the endless chains as it runs past the actuating drive, counter to the action of restoring springs disposed between the rear gripper bar and the endless chains. Although only a single such actuating drive fixed to the frame would be required and its power supply would be relatively uncomplicated, the electric or pneumatic activation of the actuating drive would be comparatively complicated, since this activation would have to ensure that the actuating drive always comes exactly into switching contact with the rear gripper bar at every machine speed and with each sheet length format setting of the rear gripper bar. There would therefore be synchronization problems.

SUMMARY OF THE INVENTION

It is accordingly an object of the invention to provide a machine for processing a sheet of printing material that overcomes the above-mentioned disadvantages of the prior art devices of this general type, which has a distance change device that is practical to implement.

With the foregoing and other objects in view there is provided, in accordance with the invention, a machine for processing a sheet of printing material. The machine contains a first chain conveyor having a front gripper bar for holding a leading edge of the sheet, a second chain conveyor having a rear gripper bar for simultaneously holding a trailing end of the sheet, a processing device associated with the first and second chain conveyors for processing the sheet, and a distance changing device for temporarily reducing a gripper distance between the front and rear gripper bars and, consequently, producing a sheet sag required for the processing of the sheet carried out by the processing device. The distance changing device defines a first circulation path of the front gripper bar, determined by the first chain conveyor, and a second circulation path of the rear gripper bar, determined by the second chain conveyor, running locally differently from each other.

The machine according to the invention for processing a sheet of printing material, contains a first chain conveyor having a first gripper bar for holding a leading edge of the sheet, and a second chain conveyor having a rear gripper bar for simultaneously holding a trailing end of the sheet. A processing device is assigned to the chain conveyors for processing the sheet. A distance changing device is provided for temporarily reducing a gripper distance between the two gripper bars and, consequently, producing a sheet sag required for the processing of the sheet carried out by the processing device. The distance changing device is formed by a first circulation path of the front gripper bar, determined by the first chain conveyor, and a second circulation path of the rear gripper bar, determined by the second chain conveyor, running locally differently from each other.

In this machine, the distance changing device is composed simply in constructional terms and can therefore be produced cost-effectively, is absolutely functionally reliable at every machine speed and every sheet length format setting and without any undesired secondary effects on sheets which, although they are transported by the chain conveyors, at the respective instant are not in the active region of the processing device. In particular, by the reduction in the gripper bar distance affected by the displacing changing device according to the invention, the deposition of aforesaid sheets on a delivery stack of the machine is not disrupted. A further advantage is now described. The distance changing device according to the invention ensure that the reduction in size of the gripper bar distance is carried out periodically. "Periodically" is understood to mean that, during each complete circulating movement of the chain conveyors, the gripper bar distance between each pair of gripper bars of the chain conveyors—in the extreme case this is only a single pair of gripper bars—is shortened at least once and then enlarged again. The distance changing device according to the invention ensure the aforesaid periodicity in a positive manner and require no electric or pneumatic activation at all for this process. Because of this positive action of the distance changing device according to the invention, synchronization problems play no role at all in the latter.

Other features which are considered as characteristic for the invention are set forth in the appended claims.

Although the invention is illustrated and described herein as embodied in a machine for processing a sheet of printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
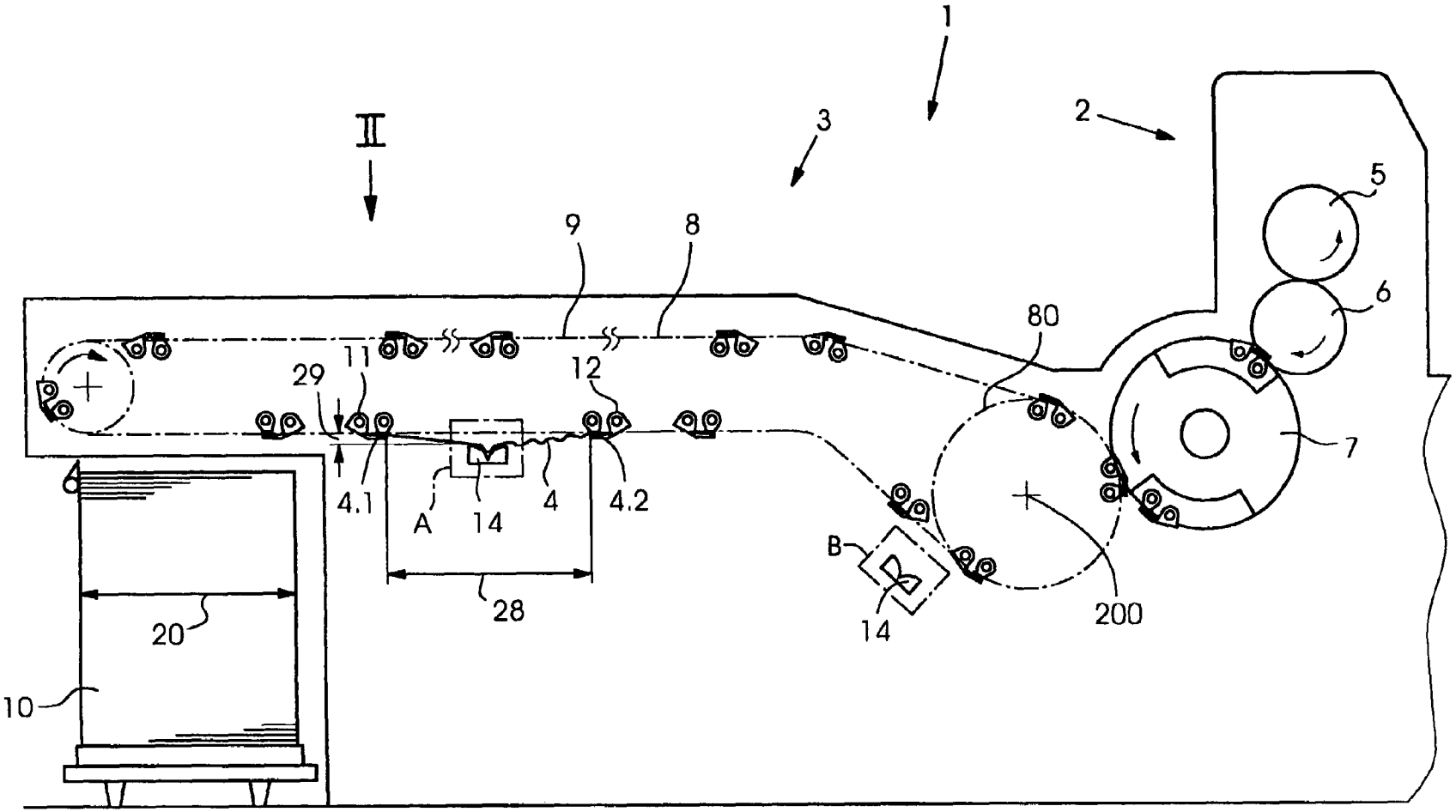
FIG. 1 is a diagrammatic, side view of a press having a deliverer.

Referring now to the figures of the drawing in detail and first, particularly, to FIG. 1 thereof, there is shown a press 1 having a lithographic printing unit 2 and a deliverer 3 for a sheet 4 of printing material having a sheet length 20. The printing unit 2 for offset printing contains a printing form cylinder 5, a blanket cylinder 6 and an impression cylinder 7. The deliverer 3 has, as sheet transport devices, a first chain conveyor 8 and a second chain conveyor 9, which transport the sheets 4 to a delivery stack 10 and circulate synchronously with one another in the process. The first chain conveyor 8 contains front gripper bars 11 for holding sheets 4 at their respectively leading sheet end 4.1 or edge, and the second chain conveyor 9 contains rear gripper bars 12 for holding the sheets 4 at their respectively trailing sheet end 4.2 or edge. The gripper bars 11, 12 function as holding devices for holding both ends of the sheets 4. The first chain conveyor 8 contains a pair of endless chains 90 (FIG. 2), which carry the front gripper bars 11 in between them, and the second chain conveyor 9 contains another pair of endless chains 140, which carry the rear gripper bars 12 between them. Therefore, during its transport carried out in a running direction 13, each sheet 4 is held firmly by the front gripper bar 11 and at the same time by the rear gripper bar 12 and is conveyed past a sheet processing device in the form of a pneumatically actuated sheet smoother 14.

Figure 4:
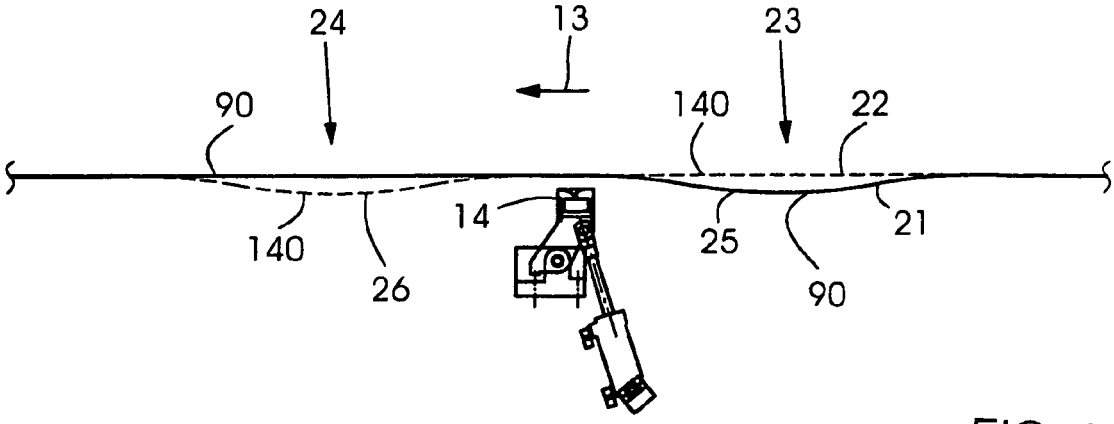
FIG. 4 is an illustration of an installation location of the sheet smoother in the deliverer.
Figure 5:
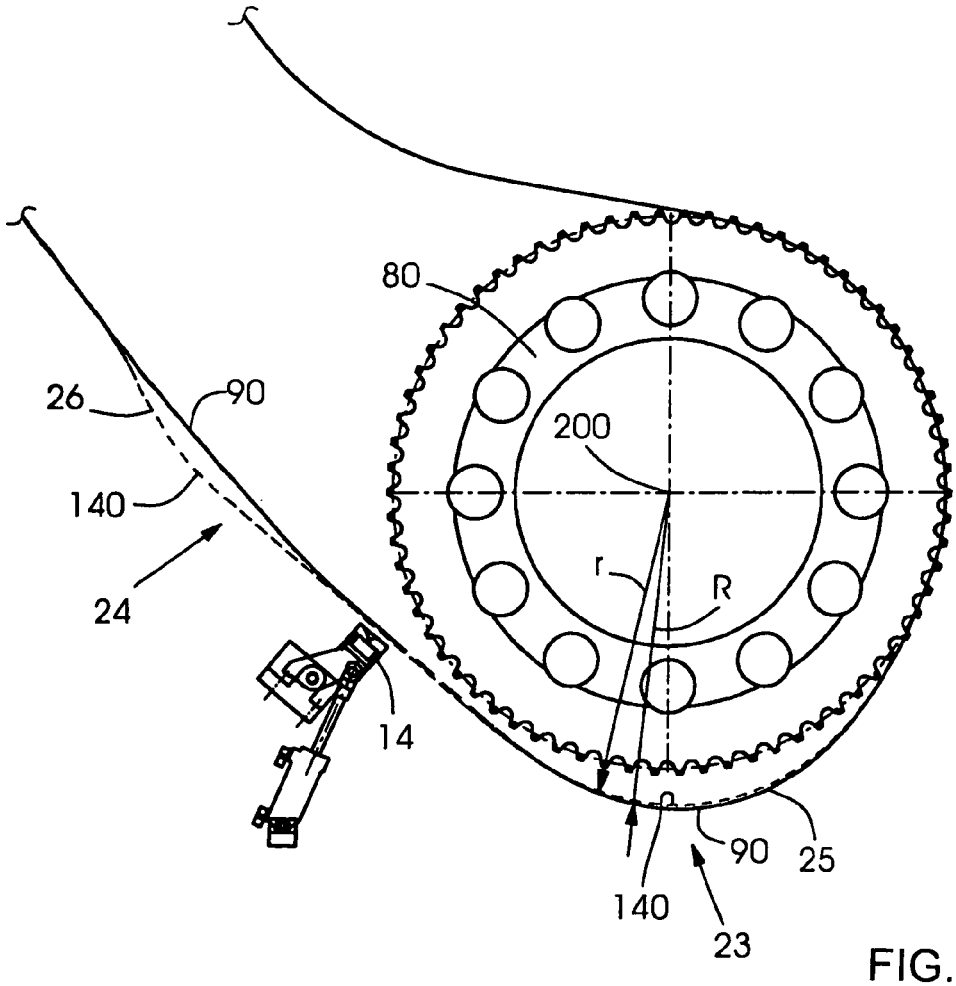
FIG. 5 is an illustration of an alternative installation location of the sheet smoother in the deliverer.

The sheet smoother 14 can be installed at an installation location A, which is illustrated in detail in FIG. 4, or at an installation location B, which is illustrated in detail in FIG. 5.

A dryer for drying the sheet 4 and the printing ink thereon could be installed at the installation locations A, B instead of the sheet smoother 14. If the processing device is the dryer, then a sheet sag 29 produced over the sheet length 20 by the distance changing device, described in more detail later, has a beneficial effect with regard to a reduction in the clamping forces required by the gripper bars 11, 12 in order to hold the sheet 4 securely.

The greater the sheet sag 29, the lower can the clamping forces be which prevent the hot air blown onto the sheets 4 by the dryer tearing the sheets 4 out of the gripper bars 11, 12.

Figure 2:
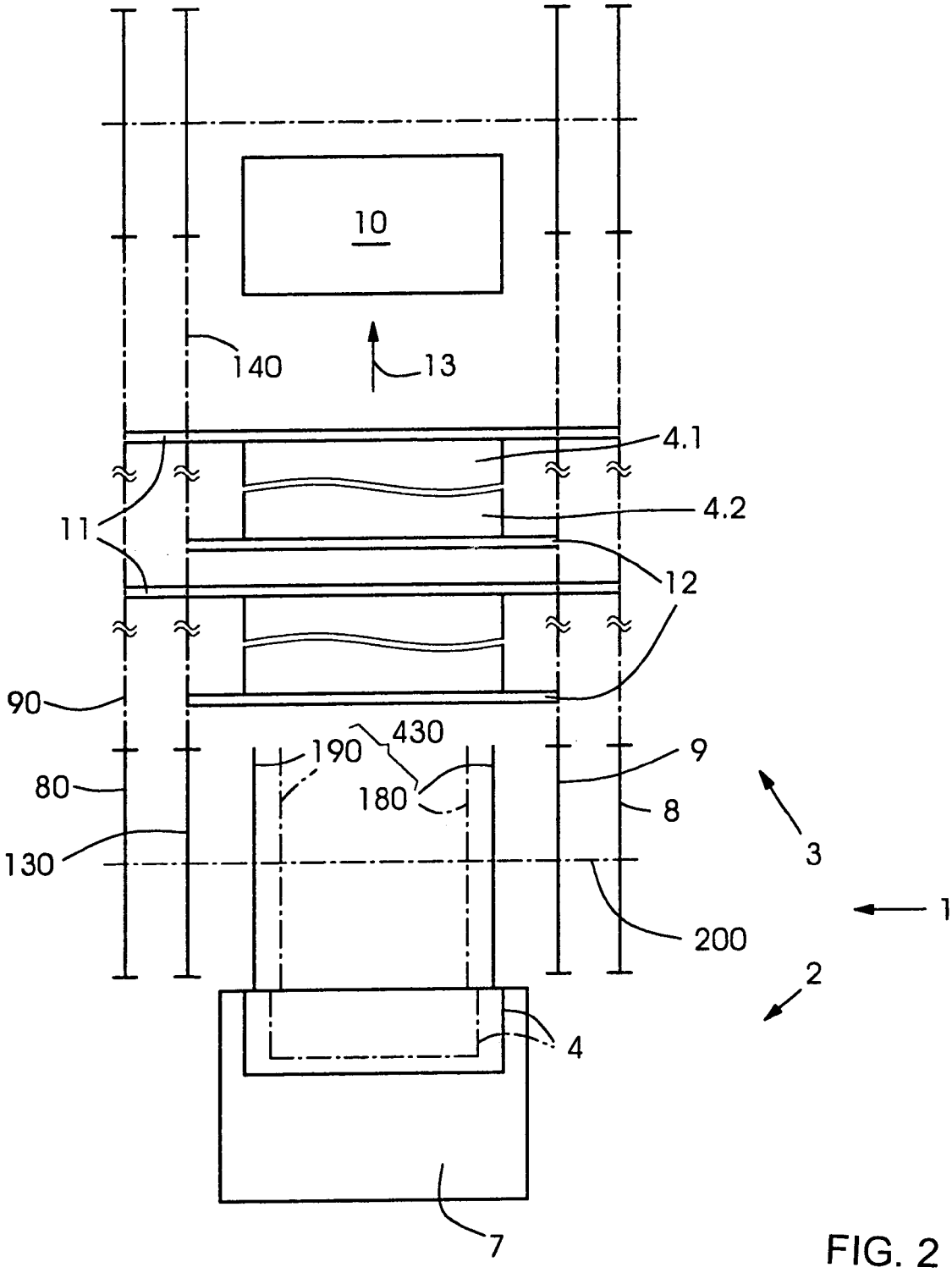
FIG. 2 is a diagrammatic, plan view of the deliverer shown in FIG. 1.

As illustrated in FIG. 2, the first chain conveyor 8 has a gear wheel or chain wheel 80 on the drive side and operating side in each case and the respective endless chain 90 running around the wheel 80. The endless chains 90 of the first chain conveyor 8 carry between them the leading gripper bars 11 in the running direction 13 for holding the leading ends 4.1 of the sheets 4. The second chain conveyor 9 likewise contains a chain wheel 130 on each of the two machine sides and the respective endless chain 140 circulating around the wheel. The endless chains 140 of the second chain conveyor 9 carry between them the trailing gripper bars 12 for holding the trailing sheet ends 4.2 in the running direction 13. Together with one of the leading gripper bars 11 in each case, each of the trailing gripper bars 12 forms a pair of gripper bars, which holds the respective sheet 4 at both ends during the transport of the latter to the delivery stack 10. By a phase adjustment of one of the chain conveyors 8, 9 relative to the other, a gripper bar distance 28 between the rear gripper bar 12 and the front gripper bar 11 of each pair of gripper bars can be set to format as a function of the sheet length 20 of the respective print job. The gripper bar distance 28 is automatically shortened by the distance changing device in order to produce the temporary sheet sag 29 of the sheet 4 to be smoothed in each case, as soon as the sheet 4 approaches the sheet smoother 14, and enlarges it automatically to the original dimension again after the sheet smoothing. In FIG. 1, the gripper bar distance 28 is illustrated in its shortened state during the sheet smoothing.

A sheet support 180 placed on the drive side and a sheet support 190 placed on the operating side are structurally identical to each other and are used to press the respective sheet 4 against a circumferential surface of the impression cylinder 7. The sheet supports 180, 190 are constituent parts of a delivery drum 430 of skeleton design belonging to the deliverer 3 and can be changed continuously along their geometrical axis of rotation 200, which is also the axis of rotation of the chain wheels 80, 130, from a format setting, shown by a solid line in FIG. 2, for maximum sheet width of the sheets 4, to a format setting, indicated by a phantom line in FIG. 2, for a minimum sheet width and also into intermediate positions for medium sheet widths lying between these two extreme settings. In each format setting, the drive-side sheet support 180 is aligned with a print-free margin, and the operating-side sheet support 190 is aligned with the other print-free margin of the respective sheet 4. The sheet supports 180, 190 are mounted such that they can be displaced axially by motors between the chain wheels of the chain conveyors 8, 9 disposed on the drive side and the chain wheels disposed on the operating side. The drive (motor, gearbox) necessary for the optional axial adjustment of the sheet supports 180, 190 toward each other or away from each other is not illustrated in the drawing in FIG. 2 for reasons of improved clarity.

Figure 3:
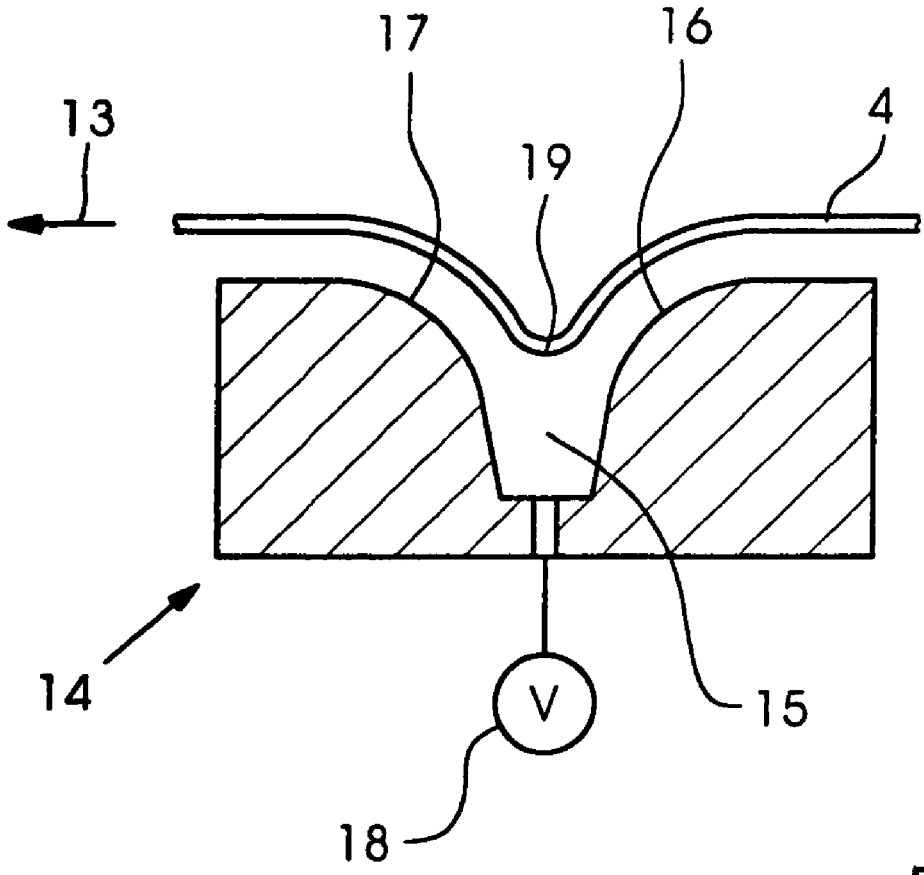
FIG. 3 is a diagrammatic, sectional view of a sheet smoother belonging to the press.

FIG. 3 illustrates the fact that the sheet smoother 14 has a smoothing gap 15, which is bounded by an entry flank 16 disposed upstream of the sheet and an exit flank 17 disposed downstream of the sheet. In the smoothing gap 15 disposed between the flanks 16, 17 there prevails a vacuum brought about by a vacuum source 18 connected thereto, which pulls the sheet 4 slightly into the smoothing gap 15, forming a printing material bead 19 in the sheet 4. The entry flank 16 and the exit flank 17 are rounded and could be provided with air jets and/or configured as rollers. During the smoothing of the sheet 4, a printing material bead 19 runs through the sheet counter to the running directly 13 and—what is particularly important—the sheet 4 is held firmly simultaneously at the front and rear, that is to say at both ends, by use of the gripper bars 11, 12.

In the following text, common features of the exemplary embodiments illustrated in FIGS. 4 and 5 will be described.

In these exemplary embodiments, the distance changing device is formed by a first circulation path 21 of the first gripper bar 11, determined by the first chain conveyor 8, and a second circulation path 22 of the rear gripper bar 12, determined by the second chain conveyor 9, running locally differently from each other. In this case, at an upstream point 23 on the path, which is located before the processing device, that is to say the sheet smoother 14, as seen in the running direction 13 of the sheet 4, the first circulation path 21 is lengthened locally relative to the course of the second circulation path 22 and, at a downstream point 24 on the path, which is located after the processing device as seen in the running direction 13, the second circulation path 22 is lengthened locally relative to the course of the first circulation path 21.

At the upstream point 23 on the path, the first circulation path 21 is lengthened locally relative to the course of the second circulation path 22, by the first circulation path 21 describing a curved deviation 25 at the upstream point 23 on the path. At the downstream point 24 on the path, the second circulation path 22 is lengthened locally relative to the course of the first circulation path, by the second circulation path 22 describing a curved deviation 26 at the downstream point 24 on the path. With regard to compensating for the path length covered by the gripper bars 11, 12 on the diversions 25, 26 of the upstream, curved deviation 25 by the downstream, curved deviation 26, it is advantageous that the two curved diversions 25, 26 are the same length as each other.

At the downstream point 24 on the path, the first circulation path 21 runs in a straight line. The first circulation path 21 runs on a different side of the second circulation path 22 at the upstream point 23 on the path than at the downstream point 24 on the path. Between the two points 23, 24 on the path, and therefore in the active region of the processing device or the sheet smoother 14, the two circulation paths 21, 22 run congruently with each other.

The two circulation paths 21, 22 have overall lengths that are equal to each other. Accordingly, during each full circuit, each front gripper bar 11 covers the same distance along the first circulation path 21 as the or each rear gripper bar 12 on the second circulation path 22. In other words, the endless chains 90, 140 to which each front gripper bar 11 is fixed have exactly the same chain length as the endless chains 140 to which the or each rear gripper bar 12 is fixed.

The special feature of the exemplary embodiment illustrated in FIG. 4 is that the second circulation path 22 runs in a straight line at the upstream point 23 on the path.

Special features of the exemplary embodiment illustrated in FIG. 5 will now be explained. At the upstream point 23 on the path, the second circulation path 22 runs in a curve with a radius of curvature r that is smaller than a radius of curvature R of the curved diversion 25 of the first circulation path 21. This results from the fact that the upstream point 23 on the path is located in that wrap region in which the endless chains 90, 140 wrap around the chain wheels 80, 130 or at least reach partly into this wrap region. In connection with this upstream point 23 on the path, the wrap region relates to the chain wheels 80, 130 placed nearer the printing unit 2 and not to the chain wheels 80, 130 of the chain conveyors 8, 9 placed closer to the delivery stack 10.

In a modification, not specifically illustrated by drawing, of the exemplary embodiments illustrated in FIGS. 4 and 5, the downstream point 24 on the path is at least partly located in the wrap region in which the endless chains 90, 140 wrap around the chain wheels placed closer to the delivery stack 10. In this modification, the second circulation path 22 at the downstream point 24 on the path runs with a radius of curvature which is greater than the radius of curvature of the curved diversion 25 of the first circulation path 21 at the downstream point 24 on the path.

This application claims the priority, under 35 U.S.C. § 119, of German patent application No. 10 2004 036 421.4, filed Jul. 27, 2004; the entire disclosure of the prior application is herewith incorporated by reference.

We claim:

1. A machine for processing a sheet of printing material, comprising:

a first chain conveyor having a front gripper bar for holding a leading edge of the sheet;

a second chain conveyor having a rear gripper bar for simultaneously holding a trailing end of the sheet;

a processing device associated with said first and second chain conveyors for processing the sheet; and a distance changing device for temporarily reducing a gripper distance between said front and rear gripper bars and, consequently, producing a sheet sag required for the processing of the sheet carried out by said processing device, said distance changing device defining a first circulation path of said front gripper bar, determined by said first chain conveyor, and a second circulation path of said rear gripper bar, determined by said second chain conveyor, running locally differently from each other.

2. The machine according to claim 1, wherein at an upstream point on a path, which is located before said processing device, as seen in a running direction of the sheet, said first circulation path is lengthened locally relative to a course of said second circulation path and, at a downstream point on said path, which is located after said processing device as seen in the running direction, said second circulation path is lengthened locally relative to a course of said first circulation path.

3. The machine according to claim 2, wherein at said upstream point on said path, said first circulation path is lengthened locally relative to said course of said second circulation path, by said first circulation path describing a curved deviation at said upstream point on said path.

4. The machine according to claim 2, wherein at said downstream point on said path, said second circulation path is lengthened locally relative to said course of said first circulation path, by said second circulation path describing a curved deviation at said downstream point on said path.

5. The machine according to claim 2, wherein:

at said upstream point on said path, said first circulation path is lengthened locally relative to said course of said second circulation path, by said first circulation path describing a first curved deviation at said upstream point on said path;

at said downstream point on said path, said second circulation path is lengthened locally relative to said course of said first circulation path, by said second circulation path describing a second curved deviation at said downstream point on said path; and said first and second curved deviations are the same length as each other.

6. The machine according to claim 2, wherein said second circulation path runs in a straight line at said upstream point on said path.

7. The machine according to claim 5, wherein at said upstream point on said path, said second circulation path runs in said second curved deviation with a radius of curvature which is smaller than a radius of curvature of said first curved deviation of said first circulation path.

8. The machine according to claim 2, wherein at said downstream point on said path, said first circulation path runs in a straight line.

9. The machine according to claim 2, wherein said first circulation path runs on a different side of said second circulation path at said upstream point on said path than at said downstream point on said path.

10. The machine according to claim 2, wherein between said upstream point and said downstream point on said path, and therefore in an active region of said processing device, said first and second circulation paths run congruently with each other.

11. The machine according to claim 1, wherein said first and second circulation paths have overall lengths which are equal to each other.

12. The machine according to claim 1, wherein said processing device is a sheet smoother.

13. The machine according to claim 1, further comprising a sheet deliverer, said first and second chain conveyors and said processing device are disposed in said sheet deliverer.

14. The machine according to claim 1, wherein the machine is a press.

* * * * *